US008912922B2

(12) United States Patent
Eichhorst

(10) Patent No.: US 8,912,922 B2
(45) Date of Patent: Dec. 16, 2014

(54) FIELD OF VIEW TRAFFIC SIGNAL PREEMPTION

(75) Inventor: Kevin Clare Eichhorst, Owatonna, MN (US)

(73) Assignee: Global Traffic Technologies, LLC, St. Paul, MN (US)

( * ) Notice: Subject to any disclaimer, the term of this patent is extended or adjusted under 35 U.S.C. 154(b) by 232 days.

(21) Appl. No.: 13/487,773

(22) Filed: Jun. 4, 2012

(65) Prior Publication Data

US 2013/0321174 A1 Dec. 5, 2013

(51) Int. Cl.
*G08G 1/07* (2006.01)

(52) U.S. Cl.
USPC ..... 340/917; 340/906; 340/907

(58) Field of Classification Search
CPC ..... G08G 1/087; G08G 1/07; G08G 1/095; G08G 1/0965
USPC ..... 340/906, 917
See application file for complete search history.

(56) References Cited

U.S. PATENT DOCUMENTS

| | | | | |
|---|---|---|---|---|
| 5,539,398 | A | 7/1996 | Hall et al. | |
| 5,986,575 | A * | 11/1999 | Jones et al. | 340/906 |
| 6,958,707 | B1 * | 10/2005 | Siegel | 340/902 |
| 2004/0147291 | A1 * | 7/2004 | Zhang et al. | 455/569.2 |
| 2005/0128103 | A1 | 6/2005 | Bachelder | |
| 2010/0045484 | A1 * | 2/2010 | Brynielsson | 340/906 |
| 2012/0326891 | A1 * | 12/2012 | Cross | 340/906 |

FOREIGN PATENT DOCUMENTS

| | | | |
|---|---|---|---|
| DE | 10 2008 041091 | | 2/2010 |
| DE | 102008041091 | A1 * | 2/2010 |

* cited by examiner

*Primary Examiner* — Kerri McNally
(74) *Attorney, Agent, or Firm* — Crawford Maunu PLLC

(57) ABSTRACT

Approaches for issuing preemption requests. The boundaries of a geo-window are repeatedly determined based on locations and headings of a vehicle as the vehicle is traveling along a roadway. The methods and systems determine whether or not any one of a plurality of intersections is located within the boundaries of the geo-window in response to changed boundaries of the geo-window. In response to determining that one of the plurality of intersections is located within the boundaries of the geo-window, a preemption request is transmitted from the vehicle to an intersection controller at the one of the plurality of intersections.

20 Claims, 7 Drawing Sheets

FIELD OF VIEW TRAFFIC SIGNAL PREEMPTION

FIELD OF THE INVENTION

The present invention is generally directed to servicing preemption requests for traffic control signals.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances, generally have the right to cross an intersection against a traffic signal. Emergency vehicles have in the past typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Traffic control preemption systems assist authorized vehicles (police, fire and other public safety or transit vehicles) through signalized intersections by making preemption requests to the intersection controllers that control the traffic lights at the intersections. The intersection controller may respond to the preemption request from the vehicle by changing the intersection lights to green in the direction of travel of the approaching vehicle. This system improves the response time of public safety personnel, while reducing dangerous situations at intersections when an emergency vehicle is trying to cross on a red light. In addition, speed and schedule efficiency can be improved for transit vehicles.

There are presently a number of known traffic control preemption systems that have equipment installed at certain traffic signals and on authorized vehicles. One such system in use today is the OPTICOM® system. This system utilizes a high power strobe tube (emitter), which is located in or on the vehicle, that generates light pulses at a predetermined rate, typically 10 Hz or 14 Hz. A receiver, which includes a photodetector and associated electronics, is typically mounted on the mast arm located at the intersection and produces a series of voltage pulses, the number of which are proportional to the intensity of light pulses received from the emitter. The emitter generates sufficient radiant power to be detected from over 2500 feet away. The conventional strobe tube emitter generates broad spectrum light. However, an optical filter is used on the detector to restrict its sensitivity to light only in the near infrared (IR) spectrum. This minimizes interference from other sources of light.

Intensity levels are associated with each intersection approach to determine when a detected vehicle is within range of the intersection. Vehicles with valid security codes and a sufficient intensity level are reviewed with other detected vehicles to determine the highest priority vehicle. Vehicles of equivalent priority are selected in a first come, first served manner. A preemption request is issued to the controller for the approach direction with the highest priority vehicle travelling on it.

Another common system in use today is the OPTICOM GPS priority control system. This system utilizes a GPS receiver in the vehicle to determine location, speed and heading of the vehicle. The information is combined with security coding information that consists of an agency identifier, vehicle class, and vehicle ID, and is broadcast via a proprietary 2.4 GHz radio.

An equivalent 2.4 GHz radio located at the intersection along with associated electronics receives the broadcasted vehicle information. Approaches to the intersection are mapped using either collected GPS readings from a vehicle traversing the approaches or using location information taken from a map database. The vehicle location and direction are used to determine on which of the mapped approaches the vehicle is approaching toward the intersection and the relative proximity to it. The speed and location of the vehicle is used to determine the estimated time of arrival (ETA) at the intersection and the travel distance from the intersection. ETA and travel distances are associated with each intersection approach to determine when a detected vehicle is within range of the intersection and therefore a preemption candidate. Preemption candidates with valid security codes are reviewed with other detected vehicles to determine the highest priority vehicle. Vehicles of equivalent priority are selected in a first come, first served manner. A preemption request is issued to the controller for the approach direction with the highest priority vehicle travelling on it.

With metropolitan wide networks becoming more prevalent, additional means for detecting vehicles via wired networks, such as Ethernet or fiber optics, and wireless networks, such as cellular, Mesh or 802.11b/g, may be available. With network connectivity to the intersection, vehicle tracking information may be delivered over a network medium. In this instance, the vehicle location is either broadcast by the vehicle itself over the network or it may be broadcast by an intermediary gateway on the network that bridges between, for example, a wireless medium used by the vehicle and a wired network on which the intersection electronics resides. In this case, the vehicle or an intermediary reports, via the network, the vehicle's security information, location, speed and heading along with the current time on the vehicle. Intersections on the network receive the vehicle information and evaluate the position using approach maps as described in the Opticom GPS system. The security coding could be identical to the Opticom GPS system or employ another coding scheme.

Prior approaches to traffic signal preemption have a number of disadvantages. For optical systems, a line of sight is required from the emitter on the vehicle to the receiver at the intersection. Fog, trees, and curves in the road may negatively impact the performance of an optical system. GPS and network-based systems use approach maps that are constructed for each intersection. Extensive effort is required to create the necessary maps for each different approach to each intersection.

SUMMARY

In one embodiment, a method is provided for issuing preemption requests. The method includes determining by an on-vehicle circuit arrangement, a location and a heading of a vehicle. The on-vehicle circuit arrangement determines boundaries of a geo-window in response to the determined location and heading. The on-vehicle circuit arrangement also determines whether or not any one of a plurality of intersections is located within the boundaries of the geo-window. In response to determining that one of the plurality of intersections is located within the boundaries of the geo-window, a preemption request is transmitted from the vehicle to an intersection controller at the one of the plurality of intersections.

In another embodiment, an on-vehicle system for issuing traffic signal preemption requests is provided. A receiver is configured and arranged to receive a location signal indicating a location of a vehicle. A storage device is configured with geographical data that identify locations of a plurality of traffic signals. A processor is coupled to the receiver and to the storage device. The processor is configured and arranged to determine a location and a heading of the vehicle in response to the location signal. The processor generates a representation of a geo-window from the location and heading of the vehicle. Based on the stored geographical data the processor determines whether or not any one of the traffic signals is located within boundaries of the geo-window. In response to determining that one of the traffic signals is located within the boundaries of the geo-window, a preemption request is generated. A transmitter is coupled to the processor and is configured and arranged to transmit the preemption request to an intersection controller of the one of the traffic signals.

A method for issuing preemption requests is provided in another embodiment. The method repeatedly determines boundaries of a geo-window based on locations and headings of a vehicle as the vehicle is traveling along a roadway. The method determines whether or not any one of a plurality of intersections is located within the boundaries of the geo-window in response to changed boundaries of the geo-window. In response to determining that one of the plurality of intersections is located within the boundaries of the geo-window, a preemption request is transmitted from the vehicle to an intersection controller at the one of the plurality of intersections.

An apparatus for issuing preemption requests is provided in another embodiment. The apparatus includes means for repeatedly determining boundaries of a geo-window based on locations and headings of a vehicle as the vehicle is traveling along a roadway; means for determining whether or not any one of a plurality of intersections is located within the boundaries of the geo-window in response to changed boundaries of the geo-window; and means, responsive to determining that one of the plurality of intersections is located within the boundaries of the geo-window, for transmitting a preemption request from the vehicle to an intersection controller at the one of the plurality of intersections.

The above summary of the present invention is not intended to describe each disclosed embodiment of the present invention. The figures and detailed description that follow provide additional example embodiments and aspects of the present invention.

BRIEF DESCRIPTION OF THE DRAWINGS

Other aspects and advantages of the invention will become apparent upon review of the Detailed Description and upon reference to the drawings in which:

FIGS. 2-1 and 2-2 show a flowchart of a process for generating preemption requests based on intersection locations relative to a geo-window maintained by on-vehicle processing circuitry;

FIG. 2-3 shows an example geo-window which is referenced in the description of the process steps for determining whether or not an intersection is within the boundaries of the geo-window;

FIG. 3-1 is a flow diagram that shows a process by which the geo-window is created and updated based on the location, heading, and speed;

FIG. 3-2 is a graph that shows the calculation of the coordinates of the midpoint of the leading edge;

FIG. 3-3 is a graph that shows the calculation of one corner of the geo-window;

FIG. 3-4 is a graph that shows the calculation of the three other corners of the geo-window;

FIG. 4 shows a primary geo-window 402 and a supplemental geo-window 404;

DETAILED DESCRIPTION

The various embodiments of the invention provide a system and method for traffic signal preemption that addresses the disadvantages of prior systems. The system does not require a line-of-sight from the vehicle to the intersection. In addition, the system is easily configured.

In one embodiment, an on-vehicle system for issuing traffic signal preemption requests is provided. The system includes a receiver that is configured and arranged to receive a location signal indicating the location of the vehicle. A processor in the system uses the location information to determine whether or not a request should be made to preempt a nearby traffic signal. In making the determination, the system uses the location information and heading of the vehicle to define an area that extends from the vehicle in the direction of travel. The defined area is referred to as the geo-window. The size of the window may be defined as a function of the speed of the vehicle or may be static, depending on implementation requirements. Data that indicate the geographical locations of a plurality of intersections are used by the on-vehicle system to determine whether or not an intersection falls within the boundaries of the geo-window. If the system determines that an intersection is located within the boundaries of the geo-window, a preemption request is generated. A transmitter transmits the preemption request to the intersection controller at the intersection.

The on-vehicle system determines whether or not to request preemption based on the geo-window it creates. This eliminates the need to create approach maps for the multiple approaches at all the controlled intersections in a jurisdiction. Having the decision made on-vehicle instead of at the intersections permits the decision making to be integrated with other vehicle management systems, such as route management systems. This allows route-specific information to be provided to the on-vehicle system as well as control over the enabling and disabling of the capability to request preemption.

As used herein, a preemption request refers to both preemption requests that emanate from emergency vehicles, as well as to what are sometimes referred to as priority requests, which emanate from mass transit vehicles, for example.

Figure 1:
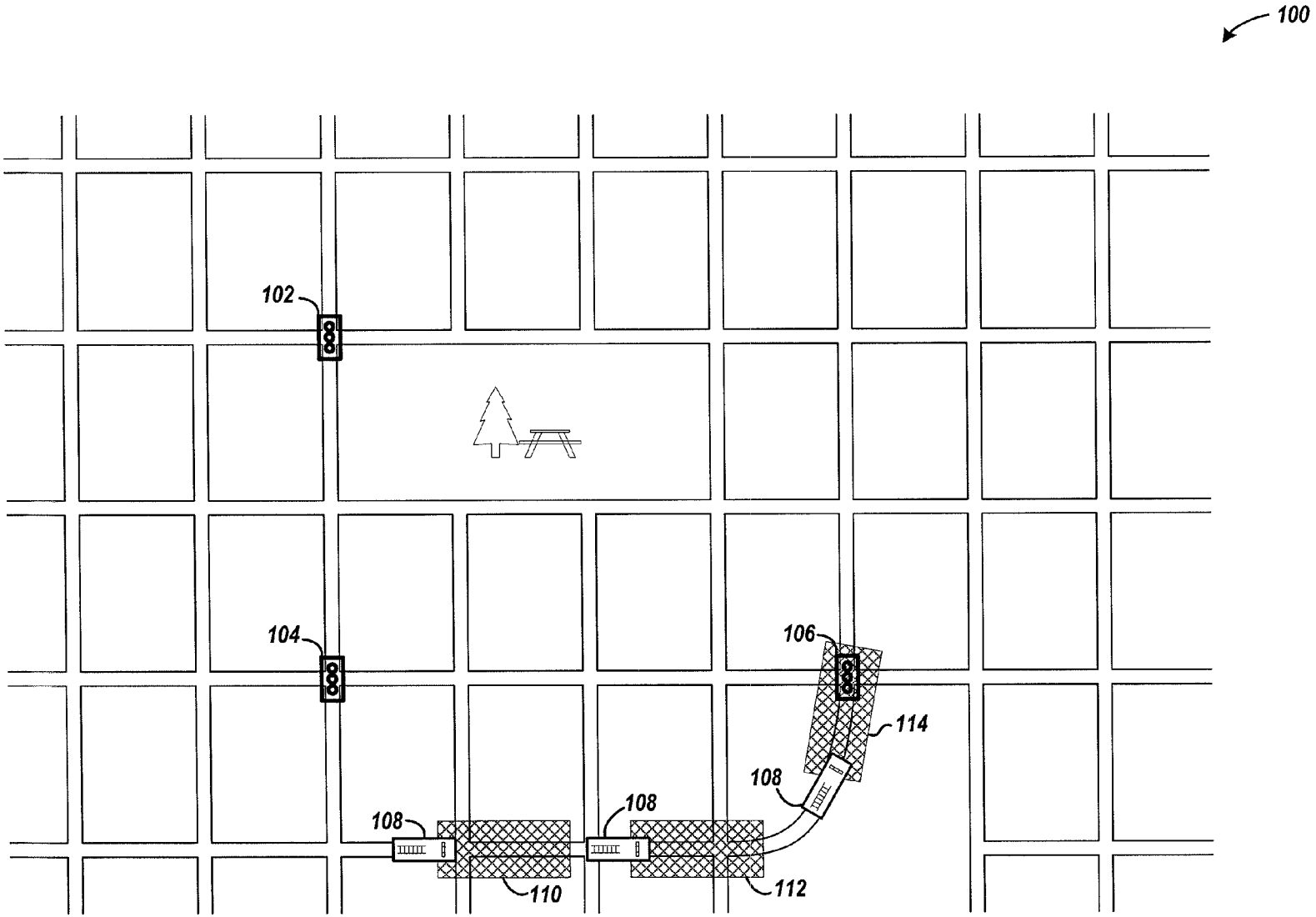
FIG. 1 is a diagram that shows geo-windows associated with a vehicle as the vehicle travels along a roadway.

FIG. 1 is a diagram that shows geo-windows associated with a vehicle as the vehicle travels along a roadway. The map 100 shows a grid of roads and controlled intersections, which are represented by traffic signal icons 102, 104, and 106. The vehicle 108 is shown at three different positions in order to depict the vehicle approaching intersection 106. At each of the three positions, the on-vehicle preemption system generates a geo-window. The geo-windows are shown as blocks 110, 112, and 114.

For emergency vehicles, the on-vehicle preemption system may be activated when the vehicle is traveling to the site of the emergency. For mass transit vehicles, the on-vehicle preemption system may be activated when the vehicle is traveling its assigned route.

Once activated, as the vehicle is moving the system repeatedly determines the boundaries of the geo-window and checks whether or not the location of the intersection is within the boundaries of the geo-window. The boundaries of the geo-window are determined based on the vehicle location and heading, which may be determined by way of a satellite positioning system, such as the GPS, or from a terrestrial system. The speed of the vehicle may be used in determining the size of the geo-window. Once the location of the traffic signal 106 falls within the geo-window 114, the on-vehicle system generates and transmits a preemption request to the traffic signal 106.

Figures 1, 2:
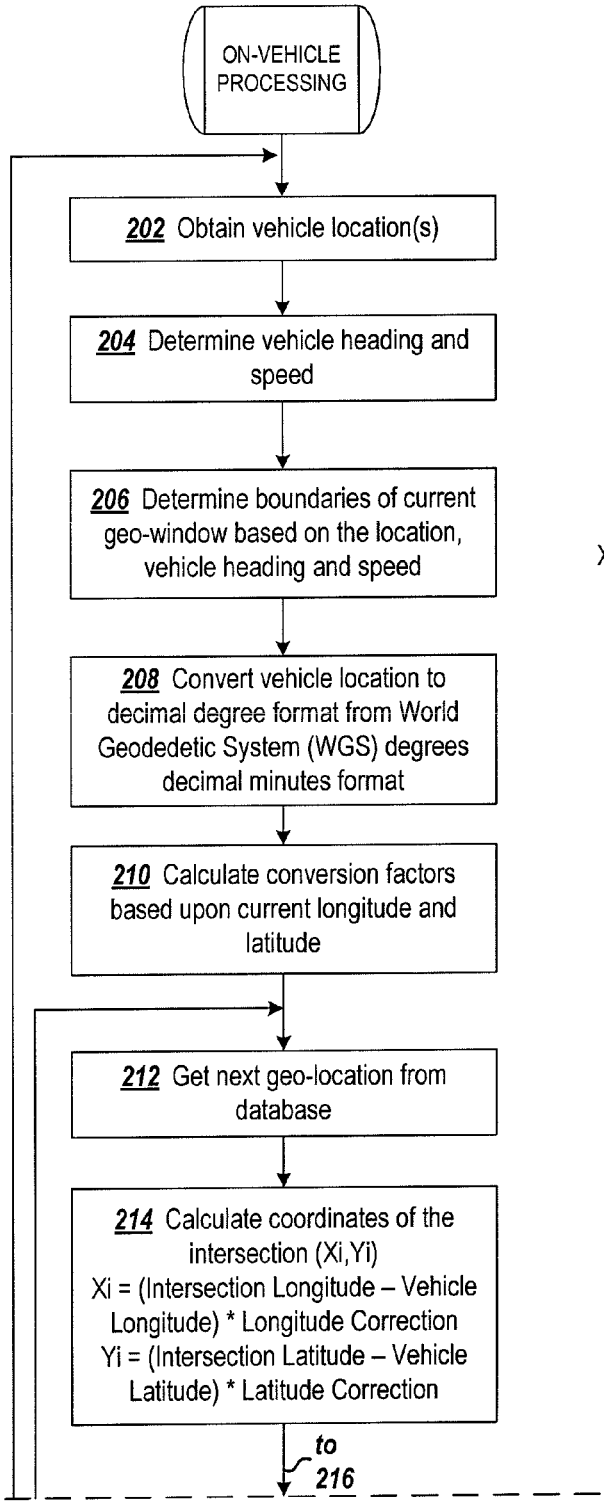

FIGS. 2-1 and 2-2 show a flowchart of a process for generating preemption requests based on intersection locations relative to a geo-window maintained by on-vehicle processing circuitry. At block 202, the location of the vehicle is determined, and at block 204, the heading and speed of the vehicle are determined. As indicated above, the location and heading may be determined using the GPS or a terrestrial system.

Figures 2, 3:
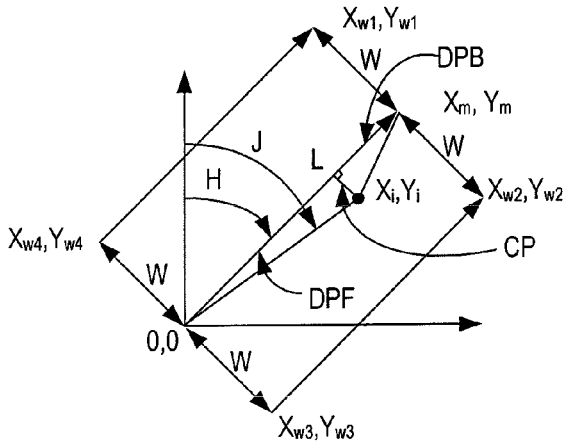
Figure 2:
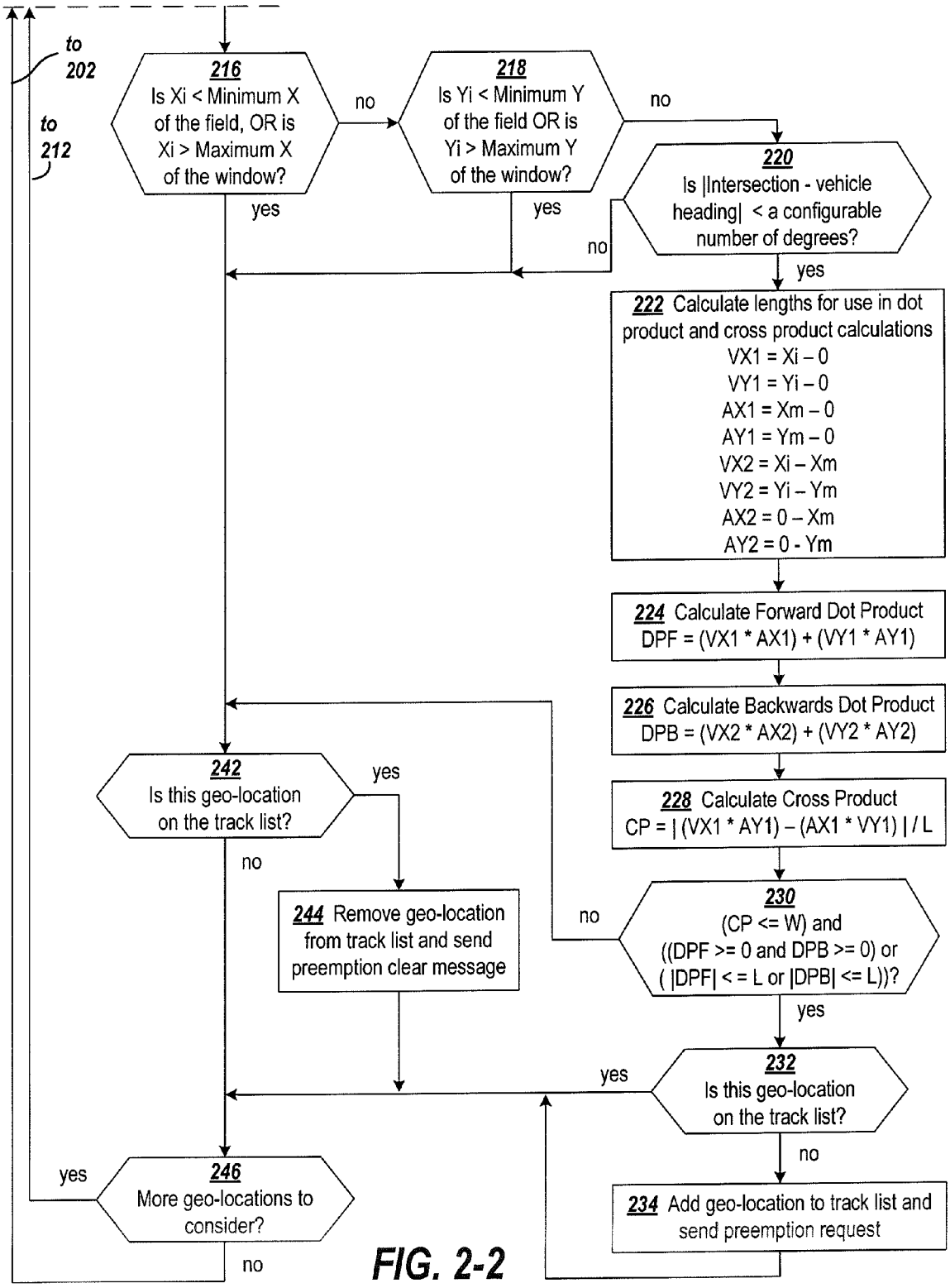
Figures 1, 3:
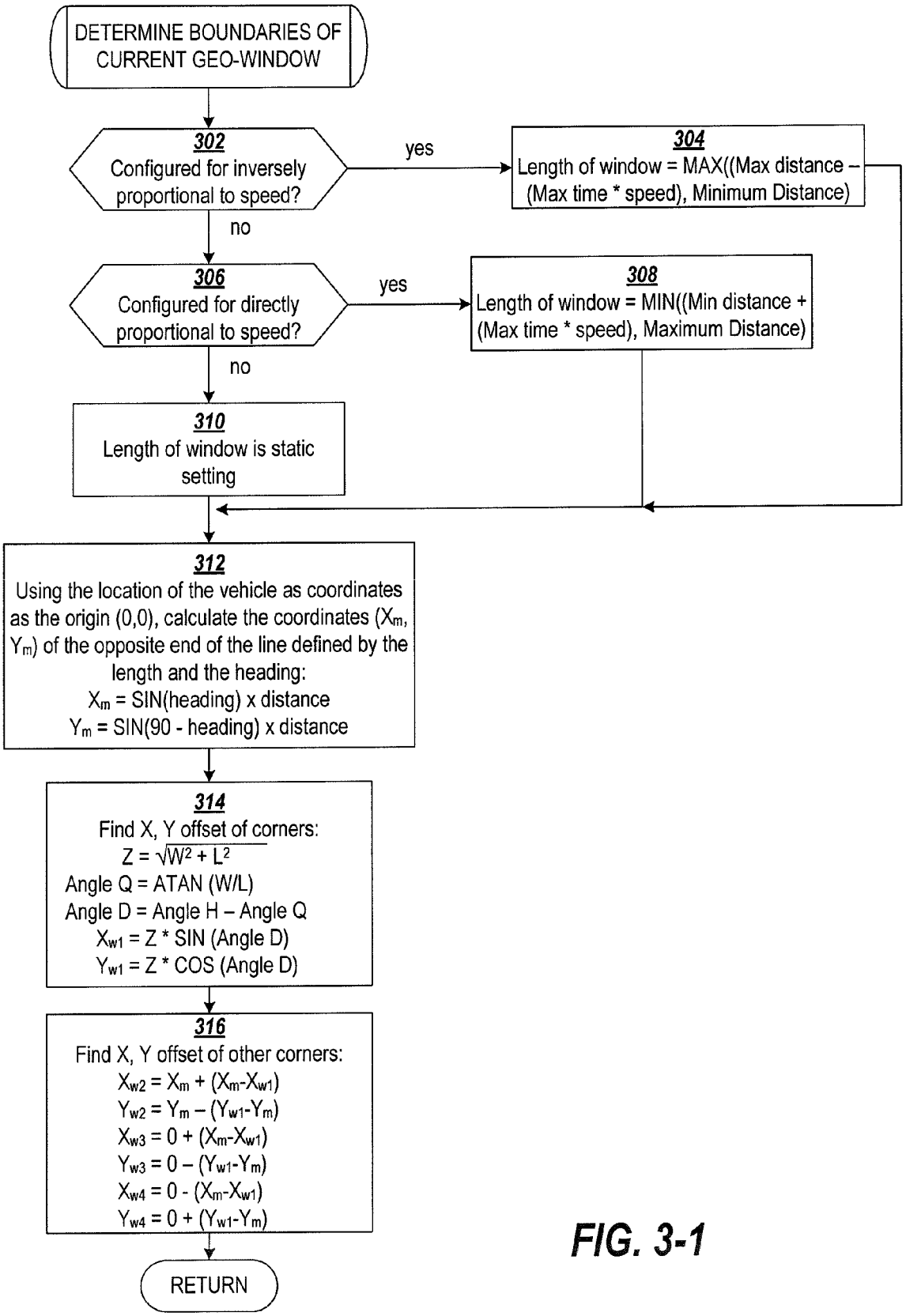
Figures 2, 3:
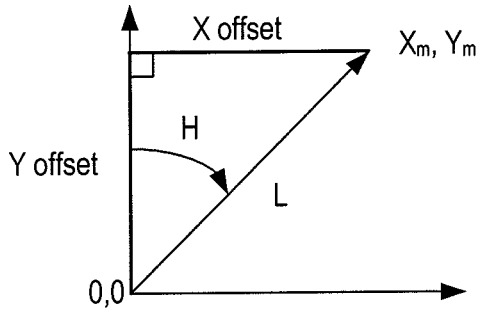
Figure 3:
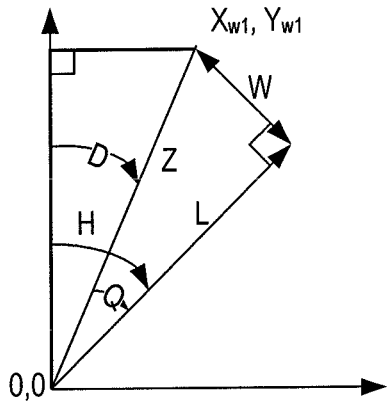
Figures 3, 4:
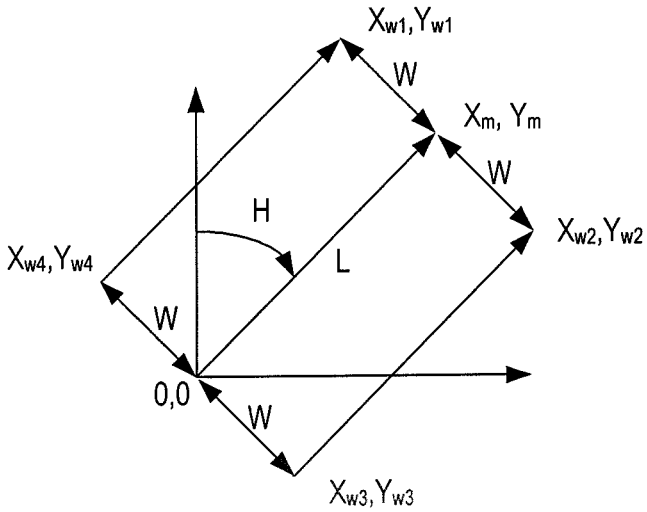
Figure 4:
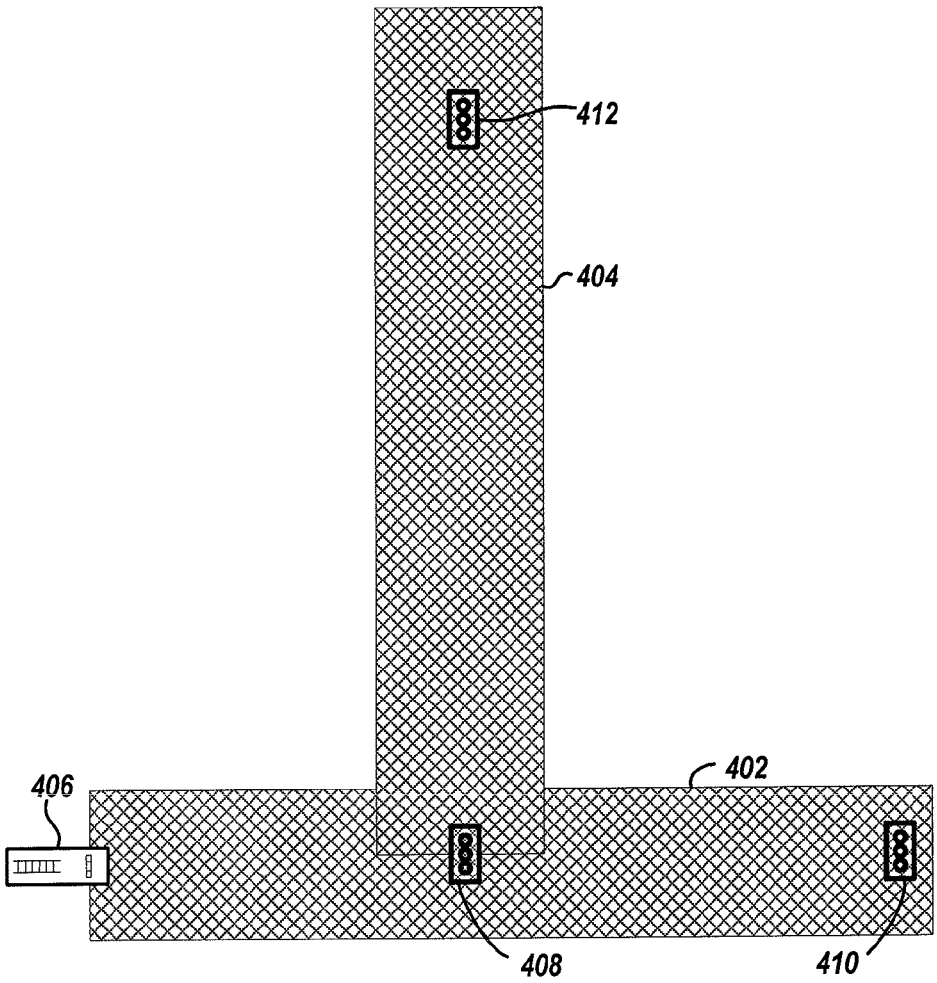

Based on the location, heading, and speed, the process determines the boundaries of the geo-window at block 206. In an alternative embodiment, the speed of the vehicle may be ignored and the size of the geo-window may be fixed. FIGS. 3-1 through 3-4 further describe the process of determining the boundaries of the geo-window. In one embodiment, the geo-window is rectangular, and the four corners of the rectangle are specified as GPS coordinates. FIG. 2-3 shows an example geo-window which is referenced in the description of the process steps for determining whether or not an intersection is within the boundaries of the geo-window.

At block 208, the process converts the coordinates of the location of the vehicle to a decimal degrees format (e.g., 123.005 degrees) from a format of the World Geodetic System. At block 210, the process computes conversion factors based on the longitude and latitude of the vehicle. The conversion factors are used to compensate for changes in the distance between longitudinal points due to convergence of lines of longitude and latitude at the poles. The conversion factors are used as longitude and latitude correction values in block 214.

At block 212, the process retrieves the location of the next intersection to process from the database. For ease of reference, geo-location is used to refer to the location of the intersection. In one embodiment, multiple locations may be associated with the location of the intersection in order to compensate for curves in the road. An example case is for an intersection at the end of a cloverleaf off-ramp. The GPS coordinates of additional locations along the cloverleaf may be associated with the intersection, such that when any of those additional locations fall within the geo-window, a preemption request is issued to preempt the traffic signal. This allows the rectangular geo-window to be used in issuing preemption requests for approaches of different shapes, while obviating the need to construct extensive approach maps along the curved road. These additional locations are used as geo-locations in the process of FIGS. 2-2 and 2-3.

At block 214, the process determines the coordinates of the geo-location relative to the location of the vehicle. The relative coordinates of the geo-location are labeled ($X_i$, $Y_1$) and are shown in the geo-window of FIG. 2-3. The longitude of the geo-location is $X_i$=(intersection longitude−vehicle longitude)*longitude correction. The latitude of the geo-location is $Y_i$=(intersection latitude−vehicle latitude)*latitude correction. The process continues at decision block 216 in FIG. 2-2.

Taken together, decision blocks 216, 218, and 220 screen for intersections that are clearly outside boundaries of the geo-window. Decision blocks 216 and 218 check whether or not the relative coordinates are beyond the minimum and maximum X and Y coordinates of the geo-window. In the geo-window shown in FIG. 2-3, the minimum X coordinate is $X_{w4}$, the maximum X coordinate is $X_{w2}$, the minimum Y coordinate is $Y_{w3}$, and the maximum Y coordinate is $Y_{w1}$. If the relative coordinates are beyond the minimum and maximum X and Y coordinates of the geo-window, the process is directed to decision block 242 since the geo-location is not within the geo-window. Otherwise, processing continues at decision block 220.

Decision block 220 checks whether or not the relative geo-location is less than a configurable number of degrees (e.g., 45 degrees) away from the heading of the vehicle. If the absolute value of the difference between the intersection (J in FIG. 2-3) and the heading of the vehicle (H) is less than the configured number of degrees, then the process continues at block 222. Otherwise, the process is directed to decision block 242. Thus, a geo-location may be within the boundaries of the rectangle (FIG. 2-3) formed by ($X_{w1}$, $Y_{w2}$), ($X_{w2}$, $Y_{w2}$), ($X_{w3}$, $Y_{w3}$), and ($X_{w4}$, $Y_{w4}$) but not qualify as being within the geo-window for triggering a preemption request.

At block 222, the process computes lengths of vectors that are used in computing dot products and a cross product, which are used in determining whether or not the relative geo-location is within the geo-window. At block 224, a forward dot product (DPF) is calculated as DPF=(VX1*AX1)+(VY1*AY1). At block 226, a backward dot product (DPB) is calculated as DPB=(VX2*AX2)+(VY2*AY2). In the example shown in FIG. 2-3, the forward dot product (DPF) is the distance from 0,0 to the projection of the relative geo-location onto the vector L. The backward dot product (DPB) is the distance from the projection of the relative location of the intersection onto the vector L to $X_m$, $Y_m$.

At block 228, a cross product CP is calculated as:

$$CP=|(VX1*AY1)-(AX1*VY1)|/L$$

The cross product CP represents the distance from vector L to the relative geo-location, $X_i$, $Y_i$.

Decision block 230 uses the forward dot product, the backward dot product, and the cross product to determine whether or not the relative geo-location is within the geo-window. If the cross product (CP) is less than or equal to ½ the width of the geo-window (W), and either the forward dot product (DPF) and the backward dot product (DPB) are both greater than or equal to 0, or at least one of the absolute value of the forward dot product (DPF) and the absolute value of the backward dot product (DPB) is less than or equal to L, then the relative geo-location falls within the geo-window. The comparison of the cross product (CP) to W is used to check whether or not the length of CP (see FIG. 2-3) extends outside of either edge $X_{w4}$, $Y_{w4}$ to $X_{w1}$, $Y_{w1}$ or edge $X_{w3}$, $Y_{w3}$ to $X_{w2}$, $Y_{w2}$. The comparisons of the forward dot product (DPF) and backward dot product (DPB) to the origin and L are used to check whether the relative geo-location projects onto L, or whether the intersection location lies beyond 0,0 or $X_m$, $Y_m$. If the geo-location is within the geo-window, block 230 directs the process to decision block 232. A track list is maintained to track which intersections were previously determined to fall within the geo-window and a preemption request is issued. Preemption requests need not be reissued for such intersections. If the current geo-location is not yet on the track list, at block 234 the geo-location is added to the track list and a preemption request is issued to the intersection. Otherwise, the process is directed to decision block 246.

If at decision block 230 the geo-location is determined to be outside the geo-window, the process continues at decision block 242. Decision block 242 tests whether a geo-location that has been determined to fall outside the geo-window is on the track list. If so, at block 244 the geo-location is removed from the track list, and a preemption clear message is sent to the intersection. The process continues at block 246. If the geo-location is not on the track list, decision block 242 directs the process to decision block 246, at which it is determined whether or not there are more geo-locations to process. If there are more geo-locations not yet considered relative to the current vehicle location, the process returns to block 212 to repeat the determining of the boundaries of the geo-window and checking whether or not any intersections fall within the boundaries. Otherwise, the process is directed to block 202 to obtain a new location of the vehicle and repeat the process of determining whether or not any intersections fall within the geo-window based on the changed vehicle location.

In another embodiment, the process may consider multiple geo-windows. For example, if a turn signal has been activated, a supplemental geo-window may be generated. The supplemental geo-window extends from an intersection that the vehicle is approaching and in the direction of the turn signal. If an intersection is located within the boundaries of the supplemental geo-window, preemption requests may be sent both to the intersection in the main geo-window and the intersection in the supplemental geo-window. This feature is further described in FIGS. 4 and 5.

In an embodiment in which a supplemental geo-window is generated in response to activation of a turn signal and to account for a possible change in direction, the process may further include making a determination as to which of the intersections that are within the primary geo-window preemption requests should be sent. For example, if there are multiple intersections in the primary geo-window and the turn signal is activated, the on-vehicle system may disregard the intersection(s) that lies beyond the intersection nearest the vehicle. In disregarding an intersection, preemption requests are not sent to the intersection controller at that intersection.

In another embodiment, the geo-fence may temporarily assume a trapezoidal shape in response to the heading of the vehicle changing such as when the vehicle is turning. This may be beneficial for situations in which an emergency vehicle is entering a roadway from a fire station or parking lot, for example.

In response to determining that the intersection is located within the geo-window or there being a location that is associated with an intersection and within the boundaries of the geo-window, the preemption request is transmitted to the identified intersection at block 212. Depending on application requirements, the preemption request may be transmitted by way of short-range radio signal or optical emitter, or by wide area network or Wi-Fi, for example.

In order to preempt the desired traffic signal, and since preemption requests are transmitted to intersections identified by the on-vehicle system, the transmitted preemption requests include information that identifies the targeted intersection(s). In one embodiment, this may be a unique intersection identifier or a network address, such as an IP address. In addition, the preemption request further includes data that indicate at least one of signal phase, heading, or position. The signal phase, heading, and position data permit the intersection controller to force or extend a green light in the desired direction.

FIG. 3-1 is a flow diagram that shows a process by which the geo-window is created and updated based on the location, heading, and speed. In one embodiment, the system is configurable to make the size of the geo-window either inversely proportional to the speed of the vehicle or directly proportional to the speed.

Configuring the system to size the geo-window inversely proportional to speed may be useful in scenarios where the vehicle is stopped, such as a bus stop, in order to provide sufficient time for intersection controllers in the path of the vehicle to schedule an extended green phase of the traffic signal. When deployed in an emergency vehicle, the system may be configured to size the geo-window in direct portion to the speed since a fast moving vehicle may arrive at an intersection in less time. The system may be further configured to employ both a minimum and a maximum length for the geo-window. The minimum length allows a minimum number of intersections to fall within the geo-window when the vehicle is not moving, and the maximum length limits the number of intersections that would fall within the geo-window for a fast moving vehicle.

If the system is configured to size the geo-window in inverse proportion to speed, decision block 302 directs the process to block 304. At block 304, the length of the geo-window is computed to be the greater of the minimum distance, or the maximum distance−(maximum time*speed). The maximum time is a configurable parameter that is the maximum period of time to look ahead (the product of the maximum time and speed provides a distance for subtracting from the maximum distance).

If the system is configured to size the geo-window directly proportional to speed, decision block 306 directs the process to block 308. At block 308, the length of the geo-window is computed to be the lesser of the maximum distance, or the minimum distance+(maximum time*speed).

If the system is configured to use a fixed size geo-window, at block 310, the length of the geo-window is set to the static length setting. For both the dynamic and fixed geo-window sizes, the width of the window is static, but may be implemented as a setting that is configurable by the user.

Blocks 312, 314, and 316 determine the Cartesian coordinates of the four corners of the geo-window based on the determined geo-window length and the heading of the vehicle.

At block 312, the process determines the coordinates of the midpoint of the leading edge of the geo-window using the determined length and the heading of the vehicle. FIG. 3-2 is a graph that shows the calculation of the coordinates of the midpoint of the leading edge. For a rectangular geo-window that extends from the vehicle into the direction of travel, the leading edge is the side that is farthest from the vehicle, and the trailing edge is opposite the leading edge and is the side nearest the vehicle. The other two sides of the geo-window are generally parallel to the heading of the vehicle.

As shown in FIG. 3-2, the midpoint of the leading edge of the geo-window is labeled with the coordinates $X_m$, $Y_m$. The heading, H, is measured from the Y axis. The x-coordinate is calculated as $X_m$=length*sin(H), and the y-coordinate as $Y_m$=length*sin(90−H).

At block 314, one corner of the leading edge of the geo-window is determined. FIG. 3-3 is a graph that shows the calculation of one corner of the geo-window. For ease of expression, the fixed width of the geo-window is 2W, and ½ the width is W.

The length from the origin to the corner of the leading edge is computed as Z=square root ($W^2$+$L^2$), and the angle Q is computed as arctan(W/L). Angle D=H−Q. Thus, the x-coordinate is $X_{w1}$=Z*sin(D), and the y-coordinate is $Y_{w1}$=Z*cos(D).

From the midpoint of the leading edge and the one corner of the leading edge, the coordinates of the other three corners may be determined as shown in block 316. FIG. 3-4 is a graph that shows the calculation of the three other corners of the geo-window.

In another embodiment, the orientation of the geo-window may vary from the orientation of the vehicle. The orientation of the vehicle as used herein is the direction of a line that extends from the rear wheel to the front wheel on the same side of the vehicle. It will be appreciated that similar, equivalent constructs may serve to illustrate the orientation of a vehicle. When the vehicle is moving along a linear path, the geo-window is oriented parallel to the vehicle. When the vehicle is changing its direction of travel, such as turning at an intersection or moving along a curve, the rate of change in the heading of the vehicle may be used to orient the geo-window. Rather than orienting the geo-window parallel to the vehicle when the vehicle is turning, the geo-window is oriented to a greater degree into the direction of the turn. The degree by which the geo-window is offset from the orientation of the vehicle may be a function of the rate of change in heading of the vehicle. That is, for a greater rate of change in heading of the vehicle, the difference between the orientation of the geo-window and the orientation of the vehicle may be greater than the difference between the orientation of the geo-window and the orientation of the vehicle when the rate of change in heading of the vehicle is a lesser amount.

The example in FIG. 1 shows different orientations of the geo-window relative to the orientation of the vehicle. Geo-windows 110 and 112 are oriented parallel to the vehicle 108. In moving around the curve in the road, the orientation of geo-window 114 is offset (not parallel to) from the orientation of the vehicle. For a sharper curve or turn, the offset may be pronounced. That is, the orientation of the geo-window is closer to being perpendicular to the orientation of the vehicle for greater rates in change of direction.

FIG. 4 shows a primary geo-window 402 and a supplemental geo-window 404. The supplemental geo-window 404 may be created in response to the activation of a turn signal in the host vehicle 406, for example. The primary geo-window 402 is generated as described above. Intersections 408 and 410 are within the boundaries of the primary geo-window 402, and intersections 408 and 412 are within range of the supplemental geo-window 404.

Figure 5:
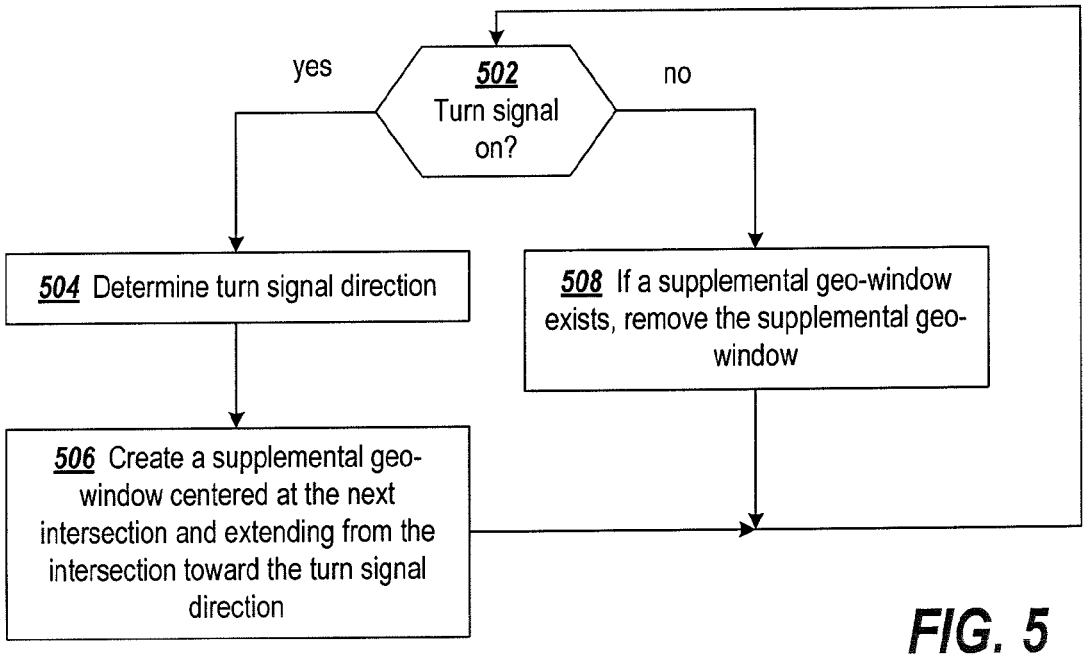
FIG. 5 is a flowchart that shows a process for generating a supplemental geo-window.

FIG. 5 is a flowchart that shows a process for generating a supplemental geo-window. In response to the turn signal having been turned on, decision block 502 directs the process to block 504. At block 504, the turn signal direction is determined (left or right).

At block 506, the process creates a supplemental geo-window. In one embodiment, the trailing edge of the supplemental geo-window is centered on the nearest intersection that the vehicle is approaching (intersection 408 in FIG. 4), and the supplemental geo-window extends in the direction of the turn signal from the nearest intersection and perpendicular to the orientation of the primary geo-window. The length of the supplemental geo-window may be made equal to the length of the primary geo-window. The coordinates of the four corners of the supplemental geo-window may be calculated in a manner similar to that described above for the primary geo-window, with the location of the midpoint of the trailing edge of the supplemental geo-window being analogous to the origin in FIGS. 3-2-3-4. In response to the turn signal having been turned off, the supplemental geo-window is removed at block 508.

Figure 6:
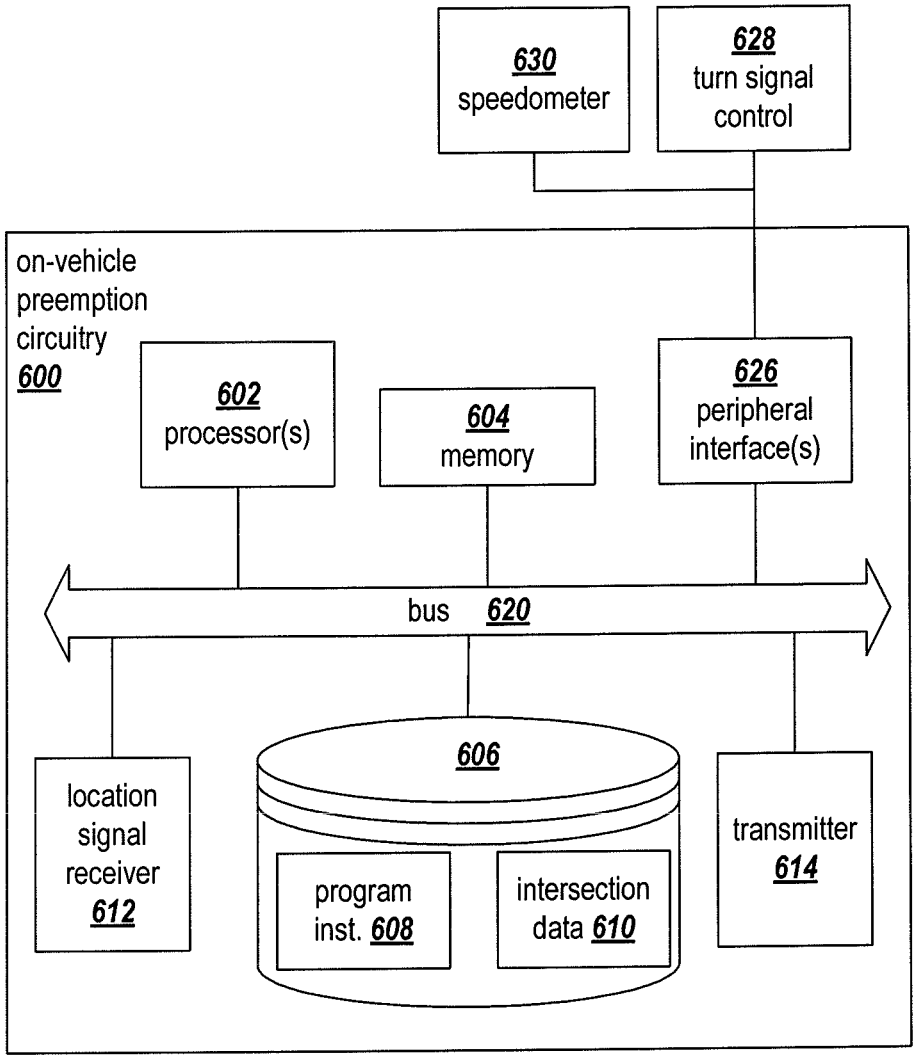
FIG. 6 is a block diagram showing a circuit arrangement for generating preemption requests based on intersection locations relative to geo-windows generated as the vehicle is moving.

FIG. 6 is a block diagram showing a circuit arrangement for generating preemption requests based on intersection locations relative to geo-windows generated as the vehicle is moving.

The preemption circuitry 600 includes a processor(s) 602, memory 604, storage 606 for program instructions and intersection data 610, all of which are coupled by bus 620. The preemption circuitry further includes a location signal receiver 612, a transmitter 614, and peripheral interface(s) 626, which are also coupled to bus 620. The peripheral interface(s) provide access to data and control signals from a turn signal 628 and speedometer 630, for example.

In an example implementation, the preemption circuitry is implemented on a Nexcom VTC 6100 in-vehicle computer. The computer includes a processor, memory, peripheral interfaces, a bus, and retentive storage for program code and data. In one implementation, the location signal receiver is a TRIMBLE® Placer Gold Series receiver, and the transmitter is a Sierra Wireless GX-400 cellular modem. Those skilled in the art will recognize that other products may be suitably configured or circuitry custom built to provide the capabilities described herein.

The storage device 606 is configured with program instructions 608 that are executable by the processor and with intersection data 610. In executing the instructions, the processor 602 performs the processes and functions described herein. The intersection data include data that identify the intersections and a set of GPS coordinates associated with each intersection identifier. The set of GPS coordinates associated with an intersection may identify one or more locations. For one of the one or more locations, the GPS coordinates identify the location of the intersection. Additional locations may be associated with an intersection identifier in order to compensate for curves in the road as described above. The GPS coordinates of additional locations along curves in the road may be associated with the intersection identifier, such that when the coordinates of any of those additional locations fall within the geo-window, a preemption request is issued to the associated intersection.

Since the on-vehicle preemption circuitry is transmitting preemption requests to intersections identified by the on-vehicle system, the transmitted preemption requests include information that identifies the targeted intersection(s). In one embodiment, this may be the same identifier that identifies the intersection in the intersection data 610. In another embodiment, a network address, such as an IP address may be sent by the transmitter 614 in order for the preemption request to be routed to and accepted by the intersection controller. For implementations using network addresses for the intersection controller, the network addresses may be stored in association with the intersection identifier in the storage device 606.

The speed of the vehicle may be determined by the processor 602 from the location and heading data received from the location signal receiver. Alternatively, the speed of the vehicle may be received by the processor from the speedometer 630 if available.

The processor receives turn signal information from the turn signal control 628 via a peripheral interface 626. The data from the turn signal indicate activation or deactivation and the direction of the turn. As described above, the turn signal information may be used to generate a supplemental geo-window.

The present invention is thought to be applicable to a variety of systems for controlling the flow of traffic. Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

What is claimed is:

1. A method for issuing preemption requests, comprising:

determining, by an on-vehicle circuit arrangement, a location and a heading of a vehicle;

calculating, by a processor of the on-vehicle circuit arrangement, coordinates that define boundaries of a geo-window in response to the determined location and heading;

determining, by the on-vehicle circuit arrangement, whether or not any one of a plurality of intersections is located within the boundaries of the geo-window;

in response to determining that one of the plurality of intersections is located within the boundaries of the geo-window, transmitting a preemption request from the vehicle to an intersection controller at the one of the plurality of intersections.

2. The method of claim 1, further comprising:

periodically determining a heading of the vehicle by the on-vehicle circuit arrangement; and periodically adjusting boundaries of the geo-window in response to the determined heading of the vehicle.

3. The method of claim 2, wherein the periodic adjusting of the boundaries of the geo-window includes defining the geo-window with a length extending from the vehicle toward the heading of the vehicle and a width that is less than the length.

4. The method of claim 3, further comprising:

periodically determining a speed of the vehicle by the on-vehicle circuit arrangement; and wherein the periodic adjusting of the boundaries of the geo-window further includes defining the length of the geo-window to be inversely proportional to the determined speed of the vehicle.

5. The method of claim 3, further comprising:

periodically determining a speed of the vehicle by the on-vehicle circuit arrangement; and wherein the periodic adjusting of the boundaries of the geo-window further includes defining the length of the geo-window to be proportional to the determined speed of the vehicle.

6. The method of claim 1, further comprising:

determining whether or not any one of a plurality of locations that are not coincident with any of the plurality of intersections is located within the boundaries of the geo-window, wherein each location of the plurality of locations is associated with one of the plurality of intersections; and in response to determining that at least one of the plurality of locations is located within the boundaries of the geo-window, transmitting a preemption request from the vehicle to an intersection controller at the intersection associated with the one location.

7. The method of claim 1, further comprising:

in response to activation of a turn signal that indicates a direction, generating a supplemental geo-window that is oriented in the direction of the turn signal;

determining, by the on-vehicle circuit arrangement, whether or not any one of the plurality of intersections is located within the boundaries of the supplemental geo-window;

in response to determining that another one of the plurality of intersections is located within the boundaries of the supplemental geo-window, transmitting a preemption request from the vehicle to an intersection controller at the another one of the plurality of intersections.

8. The method of claim 1, wherein the preemption request includes data that identify the intersection controller.

9. The method of claim 8, wherein the preemption request further includes data that indicate at least one of signal phase, heading, or position.

10. An on-vehicle system for issuing traffic signal preemption requests, comprising:

a receiver configured and arranged to receive a location signal indicating a location of a vehicle;

a storage device configured with data that indicate geographical data that identify locations of a plurality of traffic signals;

a processor coupled to the receiver and to the storage device, wherein the processor is configured and arranged to:

determine a location and a heading of the vehicle in response to the location signal;

calculate coordinates that define boundaries of a geo-window from the location and heading of the vehicle;

determine from the stored geographical data whether or not any one of the traffic signals is located within boundaries of the geo-window; and in response to determining that one of the traffic signals is located within the boundaries of the geo-window, generate a preemption request; and a transmitter coupled to the processor, wherein the transmitter is configured and arranged to transmit the preemption request to an intersection controller of the one of the traffic signals.

11. The system of claim 10, wherein the processor is further configured and arranged to:

periodically determine a heading of the vehicle by an on-vehicle circuit arrangement; and periodically adjust boundaries of the geo-window in response to the determined heading of the vehicle.

12. The system of claim 11, wherein the periodic adjustment of the boundaries of the geo-window includes defining the geo-window with a length extending from the vehicle toward the heading of the vehicle and a width that is less than the length.

13. The system of claim 12, wherein the processor is further configured and arranged to:

periodically determine a speed of the vehicle by the on-vehicle circuit arrangement; and wherein the periodic adjustment of the boundaries of the geo-window further includes defining the length of the geo-window to be inversely proportional to the determined speed of the vehicle.

14. The system of claim 12, wherein the processor is further configured and arranged to:

periodically determine a speed of the vehicle by the on-vehicle circuit arrangement; and wherein the periodic adjustment of the boundaries of the geo-window further includes defining the length of the geo-window to be proportional to the determined speed of the vehicle.

15. The system of claim 10, wherein the processor is further configured and arranged to:

determine whether or not any one of a plurality of locations that are not coincident with any of a plurality of intersections is located within the boundaries of the geo-window, wherein each location of the plurality of locations is associated with one of the plurality of intersections; and in response to determining that at least one of the plurality of locations is located within the boundaries of the geo-window, transmit a preemption request from the vehicle to an intersection controller at the intersection associated with the one location.

16. The system of claim 10, wherein the processor is further configured and arranged to:

in response to activation of a turn signal that indicates a direction, generate a supplemental geo-window that is oriented in the direction of the turn signal;

determine by an on-vehicle circuit arrangement, whether or not any one of a plurality of intersections is located within the boundaries of the supplemental geo-window;

in response to determining that another one of the plurality of intersections is located within the boundaries of the supplemental geo-window, transmit a preemption request from the vehicle to an intersection controller at the other one of the plurality of intersections.

17. The system of claim 10, wherein the preemption request includes data that identify the intersection controller.

18. The system of claim 17, wherein the preemption request further includes data that indicate at least one of a signal phase, heading, or position.

19. A method for issuing preemption requests, comprising:

repeatedly calculating by a processor of an on-vehicle circuit arrangement, coordinates that define boundaries of a geo-window based on locations and headings of a vehicle as the vehicle is traveling along a roadway;

determining whether or not any one of a plurality of intersections is located within the boundaries of the geo-window in response to changed boundaries of the geo-window; and in response to determining that one of the plurality of intersections is located within the boundaries of the geo-window, transmitting a preemption request from the vehicle to an intersection controller at the one of the plurality of intersections.

20. An apparatus for issuing preemption requests, comprising:

means for repeatedly calculating coordinates that define boundaries of a geo-window based on locations and headings of a vehicle as the vehicle is traveling along a roadway;

means for determining whether or not any one of a plurality of intersections is located within the boundaries of the geo-window in response to changed boundaries of the geo-window; and means, responsive to determining that one of the plurality of intersections is located within the boundaries of the geo-window, for transmitting a preemption request from the vehicle to an intersection controller at the one of the plurality of intersections.

* * * * *